US006176527B1

(12) United States Patent
Bench

(10) Patent No.: US 6,176,527 B1
(45) Date of Patent: Jan. 23, 2001

(54) SECURITY LOCKING MECHANISM

(75) Inventor: Maurice Bench, West Hunsbury (GB)

(73) Assignee: Florin Investments Limited (TC)

( * ) Notice: Under 35 U.S.C. 154(b), the term of this patent shall be extended for 0 days.

(21) Appl. No.: 09/304,388

(22) Filed: May 4, 1999

(30) Foreign Application Priority Data

May 5, 1998 (GB) ..... 9809474
Feb. 8, 1999 (GB) ..... 9902762

(51) Int. Cl.[7] ..... E05B 15/02
(52) U.S. Cl. ..... 292/340; 292/33; 292/340.15
(58) Field of Search ..... 292/340, 341.5, 292/341.17, 341.18, 40, 179, 177, 139, 332, 33; 49/395, 183

(56) References Cited

U.S. PATENT DOCUMENTS

| | | | | |
|---|---|---|---|---|
| 266,903 | * | 10/1882 | Schertzer | 292/33 |
| 2,672,745 | * | 3/1954 | Marchetti | 70/101 |
| 3,788,679 | * | 1/1974 | Banham | 292/40 |
| 4,435,921 | * | 3/1984 | Marin | 292/40 |

FOREIGN PATENT DOCUMENTS

| | | | | |
|---|---|---|---|---|
| 24280 | * | 8/1901 | (CH) | 292/33 |
| 90 12 057 | | 1/1991 | (DE) | 15/2 |
| 197 23 361 | | 1/1998 | (DE) . | |
| 391251 | | 10/1908 | (FR) . | |
| 2418852 | | 9/1979 | (FR) | 15/2 |
| 6276 | | of 1913 | (GB) . | |
| 173299 | | 12/1921 | (GB) . | |
| 2075106 | | 11/1981 | (GB) | 9/8 |
| 2209049 | | 4/1989 | (GB) | 63/14 |
| 2227519 | | 1/1990 | (GB) | 1/2 |
| 2299612 | | 9/1996 | (GB) | 15/2 |
| 244885 | * | 2/1926 | (IT) | 292/33 |
| 8105627 | | 7/1983 | (NL) | 63/14 |

* cited by examiner

*Primary Examiner*—Teri Pham
(74) *Attorney, Agent, or Firm*—Cherskov & Flaynik

(57) ABSTRACT

The present invention provides a cost effective security locking mechanism for improving the security between a frame member and the masonry surrounding the frame member and additionally for enhancing the strength of engagement between the frame and a door associated with the frame. A substantial proportion of any force exerted on the door, when in the locked condition, is transmitted directly to the masonry surrounding the frame by means of auxiliary bolts and tubular metal anchorages.

18 Claims, 4 Drawing Sheets

2
12
50
20
26
72
40
14
46
24
34
70
32
44
30
42
60
48
4
22
6
8
10

SECURITY LOCKING MECHANISM

BACKGROUND OF THE INVENTION

1. Field of the Invention

The invention relates to a security locking mechanism for enhancing the security provided by a lock carried by a wing such as a door or window.

2. Description of the Related Art

It has always been advantageous to provide a door, window or the like with a number of locking devices so as to deter or prevent a would-be intruder. Conventionally, this has been achieved by installing on the wing, or indeed on a frame associated with the wing, a plurality of separate locking devices each requiring a separate key or handle. Naturally, the operation of such a system is a relatively arduous and time consuming task.

DE 19723361 discloses a novel and simple locking system that has, to some extent, alleviated the problems associated with the aforementioned system. This document describes a system wherein the insertion of a single bolt from a door into a keeper in the associated frame simultaneously causes the extension of auxiliary bolts from the frame member into housings provided on the door. This system enhances the security between, and the engagement of, the door and the frame.

Although door security is improving continuously, the majority of the development carried out in this field is primarily concerned with improving the strength of the door or, as discussed in DE 19723361, improving the strength of engagement between the door and its frame.

Insofar as the applicant is aware, there has not been a comparable improvement in the security provided between the door frame and the surrounding masonry to which it is affixed. A member of the public may choose to install a system such as that disclosed in DE 19723361 into a door and its associated frame. This undoubtedly would improve the strength of engagement between the two members and any force exerted on the door would be transmitted directly to the frame. However, repetitive forcing or barrage of the door induces stress within the frame and eventually the frame, which is normally quite a weak member, would yield.

Accordingly, the present invention seeks to redress the problems discussed above by providing an easy to use and cost effective locking mechanism which improves the security between the frame and the surrounding masonry as well enhancing the strength of engagement of the door and the frame. The mechanism reduces the stress induced in the frame by transmitting a substantial proportion of the force exerted on the door directly to the masonry surrounding the frame. Furthermore, this new locking device can be retrofitted to existing doors without the need for providing a new lock.

BRIEF SUMMARY OF THE INVENTION

A security locking mechanism for enhancing the security provided by a lock carried by a wing such as a door or window, the security locking mechanism comprising an auxiliary bolt mechanism for mounting in a frame for the wing and an auxiliary keeper for mounting in the wing, wherein extension of a bolt of the lock into a keeper of the auxiliary bolt mechanism causes extension of an auxiliary bolt of the auxiliary bolt mechanism into the auxiliary keeper against a resilient bias, the auxiliary bolt mechanism comprising a metal housing which in use is received in a recess in the frame and an actuating lever which is pivotally mounted intermediate its ends in the housing, is pivotally connected at one end portion to a keeper plate positioned to be depressed by extension of the bolt into the keeper, and is pivotally connected at the opposite end portion to the auxiliary bolt, wherein the auxiliary bolt is slidable in a tubular metal anchorage which projects rearwardly from the metal housing and in use is received in and anchored by the masonry or other structural support for the frame; and when extended against the resilient bias the auxiliary bolt has one end portion received in the tubular metal anchorage and the other end portion received in the auxiliary keeper of the wing.

Preferably, the keeper plate is fast to a shaft which is axially slidable in a tubular metal guide which projects rearwardly from the metal housing and in use is received in and anchored by the masonry or other structural support for the frame.

The security locking mechanism may be used in association with a surface-mounted lock, wherein the keeper in use is located outside the width of the frame alongside the surface-mounted lock, and the keeper plate bridges the width of the frame and the keeper so that extension of the bolt of the lock into the keeper outside the width of the frame is communicated by the keeper plate to the lever and auxiliary bolt within the width of the frame. Such a surface-mounted lock is one which has as its sole bolt a latch bolt.

Alternatively, the security locking mechanism may be used in association with a lock which has both a latch bolt and a deadbolt, wherein the keeper plate is positioned in the housing so as to be depressed by extension of either the latch bolt or the deadbolt into the keeper.

Preferably, the auxiliary bolt mechanism comprises a second actuating lever on the opposite side of the keeper plate to the actuating lever, the second actuating lever being pivotally mounted intermediate its ends in the housing, being pivotally connected at one end portion to the keeper plate and being pivotally connected at its opposite end portion to a second auxiliary bolt which is slidable in a second tubular metal anchorage which projects rearwardly from the metal housing and in use is received in and anchored by the masonry or other structural support for the frame.

The security locking mechanism may further comprise a metal face plate securable to the front of the metal housing. Additionally, a pair of tubular metal structural members can be secured to the back wall of the metal housing and extending from the back wall to the metal face plate, and in alignment with the tubular metal structural members fixing holes formed through the face plate and the back wall of the metal housing, for fixing the face plate and housing directly to the masonry or other structural support for the frame by means of securing screws or bolts passing through the fixing holes, the tubular metal structural members and the frame and obtaining an anchorage in the masonry or other structural support.

The housing may be provided with a deformable member or housing portion in the region of the keeper plate, positioned so that if an attempt is made to force open the wing while it is locked, the deformable member will bend into a position blocking keeper plate movement, in which position it prevents the keeper plate from returning from its depressed condition even when the bolt is withdrawn.

Additionally, the security locking mechanism can be provided with a release mechanism connected to the actuating lever and passing through a side wall of the housing and in use through the frame to one side only of the frame, for moving the actuating lever so as to disengage the auxiliary bolt mechanism in the event that the mechanism sticks in the locking condition.

The security locking mechanism may be extended using a supplementary locking mechanism. Such a supplementary locking mechanism can be used for securing the door to the frame, and includes: a supplementary bolt, housed within and extensible from the door, for spanning the gap between the door and the frame, the supplementary bolt being resiliently biased to a retracted condition in which the door is movable relative to the frame; a supplementary actuating lever pivotally mounted at a position intermediate of its ends in the door and having one end portion engagable with the supplementary bolt to move the supplementary bolt against the resilient bias to a position spanning said gap, the other end portion of the supplementary actuating lever being engagable with the auxiliary bolt of the security locking mechanism such that extension of the auxiliary bolt into the auxiliary keeper in the wing causes pivotal rotation of the supplementary actuating lever to move the supplementary bolt against the resilient bias for receipt within a keeper formed in the frame.

DETAILED DESCRIPTION OF THE INVENTION

Figure 1:
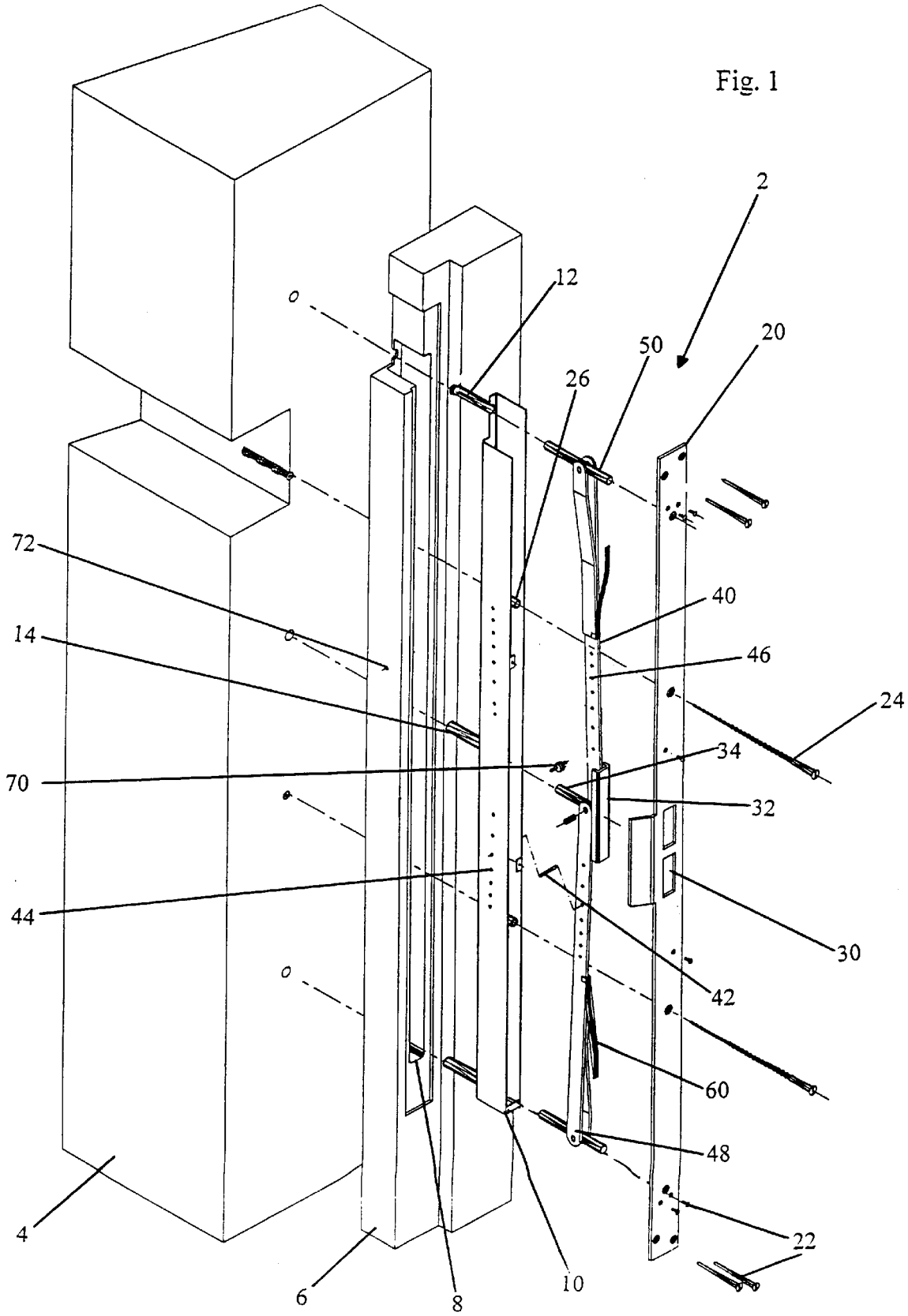
FIG. 1 is an exploded perspective view of a first embodiment of a security locking mechanism according to the invention.
Figure 2:
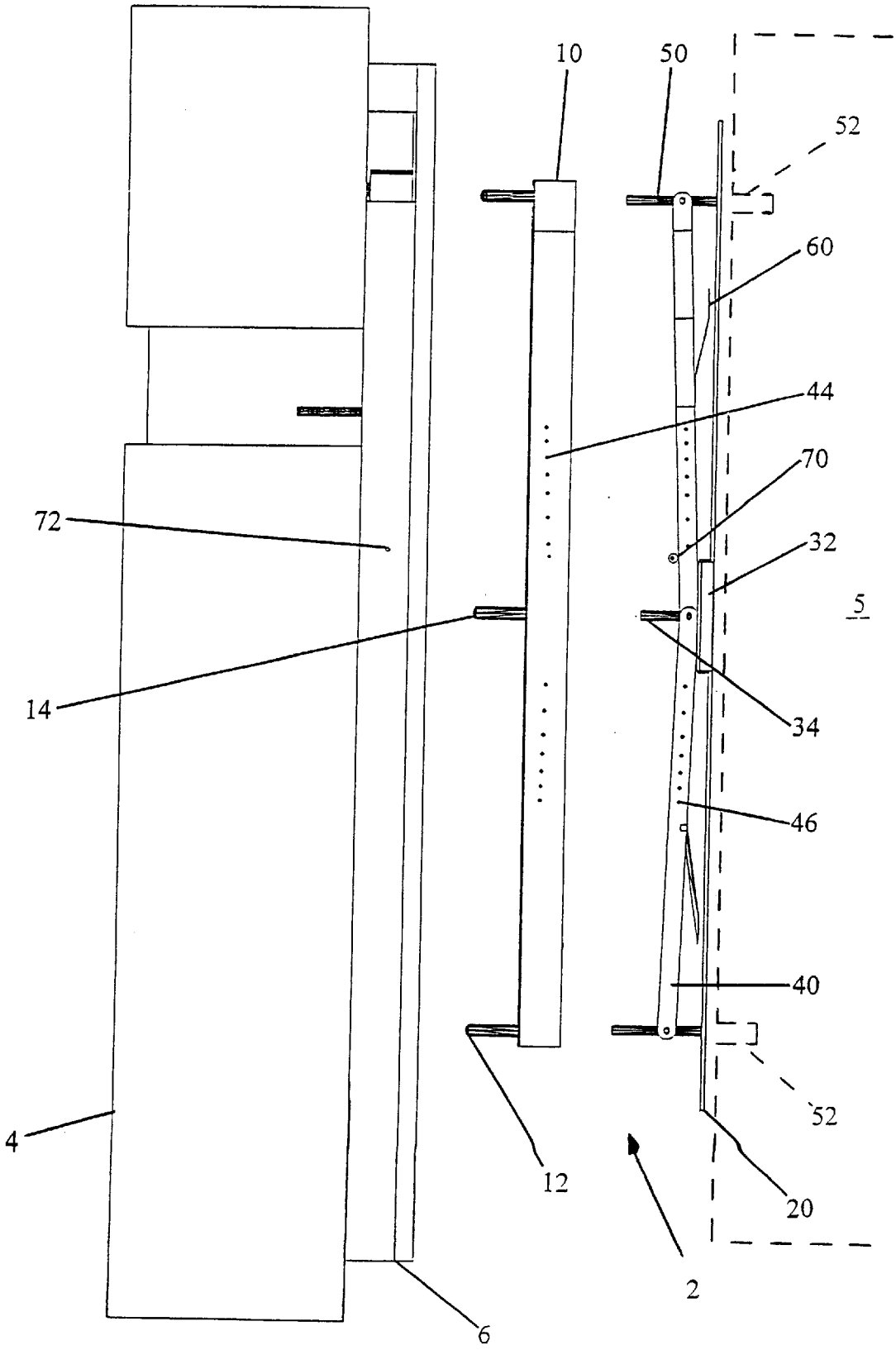
FIG. 2 is an exploded sectional side view of the locking mechanism of FIG. 1 in an open or unlocked position.
Figure 3:
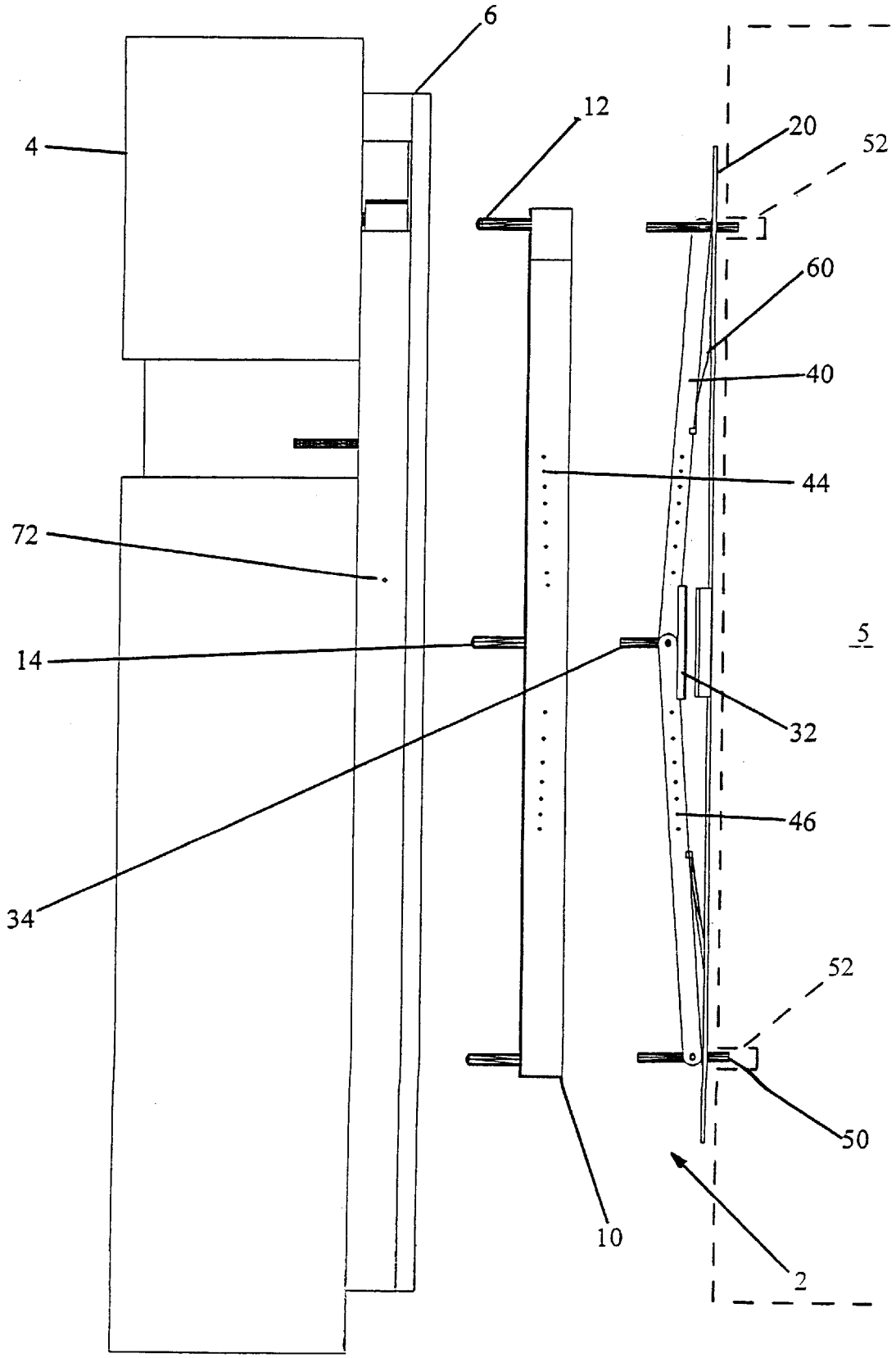
FIG. 3 is an exploded sectional side view of the locking mechanism of FIGS. 1 and 2 in a closed or locked position.

FIGS. 1, 2 and 3 show a security locking mechanism according to the invention. The locking mechanism comprises an auxiliary bolt mechanism 2 which is mounted within a recess 8 provided in a door frame 6 and anchored to the masonry or other structural support 4 surrounding the frame 6. The auxiliary bolt mechanism 2 is activated by extension of a bolt from a lock carried by a door (depicted in dotted lines in FIGS. 2 and 3).

FIG. 1, in particular, shows an embodiment of the present invention which is for use in conjunction with a sash-type lock provided in a door.

The auxiliary bolt mechanism 2 has a metal monocoque housing 10 having a single exposed open surface. The housing 10 is anchored through the door frame 6 and embedded therein within the recess 8. Anchorage to the surrounding masonry is achieved by means of two hollow tubular metal anchorages 12 and a hollow tubular metal guide 14. The tubular metal anchorages 12 are located substantially at either end of the auxiliary bolt mechanism 2 on the rearwardly facing side of the monocoque housing 10 (that side which opposes the open surface of the monocoque housing 10) and extend therefrom into the surrounding masonry 4 through the recess 8 formed in the frame 6. The tubular metal guide 14 is positioned substantially in the middle of the auxiliary bolt mechanism 2 on the rearwardly facing side of the monocoque housing 10 and extends therefrom, in a similar manner, into the masonry 4.

The moving parts of the auxiliary bolt mechanism 2 are contained within the monocoque housing 10 and these will be described later on in the description.

The exposed open surface of the monocoque housing 10 is covered with a metal face plate 20 which is fitted flush with the exposed surface of the door frame 6. Fixing screws 22 are used to fasten the face plate 20 to the housing 10 and to secure the face plate 20 to the frame 6. Two long tapered masonry screws 24 are used to secure the auxiliary bolt mechanism 2 to the masonry 4 surrounding the frame 6. These masonry screws 24 are inserted through holes in the face plate 20 and pass through hollow cylindrical metal shafts 26 extending from the face plate 20 to the rear of the housing 10. The masonry screws 24 then extend through holes provided in the rearwardly facing surface of the monocoque housing 10, through the base of the recess 8 provided within the frame 6 and into the masonry 4 surrounding the frame 6.

The metal face plate 20 is further provided with a keeper 30 into which a latch bolt and/or a deadbolt extensible from the door may be inserted to abut a keeper plate 32 provided within the monocoque housing 10 thereby activating the auxiliary bolt mechanism 2. The keeper plate 32 is provided with a guidance shaft 34 which is slidably received within the hollow tubular guide 14 mounted on the rearward face of the housing 10. The guidance shaft 34 is of such a length that when the keeper plate 32 is in its non-depressed condition (in abutment with the face plate 20), a portion of the guidance shaft 34 is still received in the hollow tubular guide 14. This ensures smooth, non-fouling movement of the keeper plate 32 when a bolt is inserted into the monocoque housing 10 through the keeper 30 on the face plate 20.

The inner face of the keeper plate 32 engages with two actuating levers 40. The first of these actuating levers 40 extends upwards from the keeper plate 32, while the second of the actuating levers 40 extends downwards from the keeper plate 32.

A pivot pin 42 is inserted through a pivot hole 46 provided on each of the actuating levers 40 at an intermediate position thereof. Each such pivot pin 42 is secured to the metal monocoque housing 10 at a pivot point 44. A plurality of pivot points 44 and corresponding pivot holes 46 are provided on the monocoque housing 10 and actuating lever 40 respectively. This enables the user to select one out of a range of moments that the actuating lever 40 may have about the pivot pin 42 depending upon the circumstances of installation.

The other end of each actuating lever 40 is double pronged and an auxiliary bolt 50 is positioned in the gap provided between the prongs 48. The auxiliary bolt 50 is provided with a holding pin which engages with a holding recess in one or each of the prongs 48 of the actuating lever 40. The holding recess may be in the form of a simple hole through which the holding pin is inserted. Alternatively, the holding recess may be arcuate in which case the holding pin can be snap-fitted into the holding recess.

The auxiliary bolt 50 is slidably housed within the tubular metal anchorage 12 and is of such a length that on full extension (the locked condition), a portion of the auxiliary bolt 50 remains within the tubular metal anchorage 12. Thereby, when the auxiliary bolt mechanism 2 assumes the locked position, a substantial portion of the force exerted on the door will be transferred to the surrounding masonry 4 through auxiliary keepers 52 formed within the door 5, the auxiliary bolts 50, the metal monocoque housing 10, the masonry screws 24, the tubular metal guide 14 and the tubular metal anchorages 12.

A leaf spring 60 is mounted on each of the actuating levers 40 at an intermediate section thereof at the side of the pivot pin 42 which is remote from the keeper plate 32. Each leaf spring 60 is disposed between the actuating lever 40 and the metal face plate 20 for engagement with the face plate 20 on rotation of the associated actuating lever 40.

As illustrated in FIG. 3, in operation, on extension of the latch bolt or deadbolt through the keeper 30 and into the metal monocoque housing 10, the keeper plate 32 is pushed to the rear of the housing 10 and the actuating levers 40 rotate resulting in extension of the auxiliary bolts 50 out from the housing 10 against the biasing force developed by the leaf springs 60 through auxiliary bolt holes provided on the face plate 20 for engagement with auxiliary keepers 52 housed within the door 5.

Conversely, as shown in FIG. 2, as the latch bolt or deadbolt is removed from the keeper 30, the leaf springs 60 are of sufficient strength to withdraw the auxiliary bolts 50 from the auxiliary keepers 52 and into the housing 10 and are simultaneously capable of traversing the keeper plate 32 to the front of the monocoque housing 10.

There may be occasions when the auxiliary bolts 50 fail to retract back into the monocoque housing 10 when the bolt from the door is withdrawn from the keeper 30. For this reason there is provided an emergency release cam mechanism 70 within the monocoque housing 10 which engages with one of the actuating levers 40 of the auxiliary bolt mechanism 2. The cam mechanism 70 is accessible from one side of the frame through an access hole 72 provided therein. If necessary, a screw driver can be inserted into the access hole 72 for rotatable engagement with the cam mechanism 70 which in turn rotates the actuating lever 40 which it engages thereby traversing the keeper plate 32 to the front of the monocoque housing 10 and retracting both auxiliary bolts 50 back into the housing 10.

Figure 4:
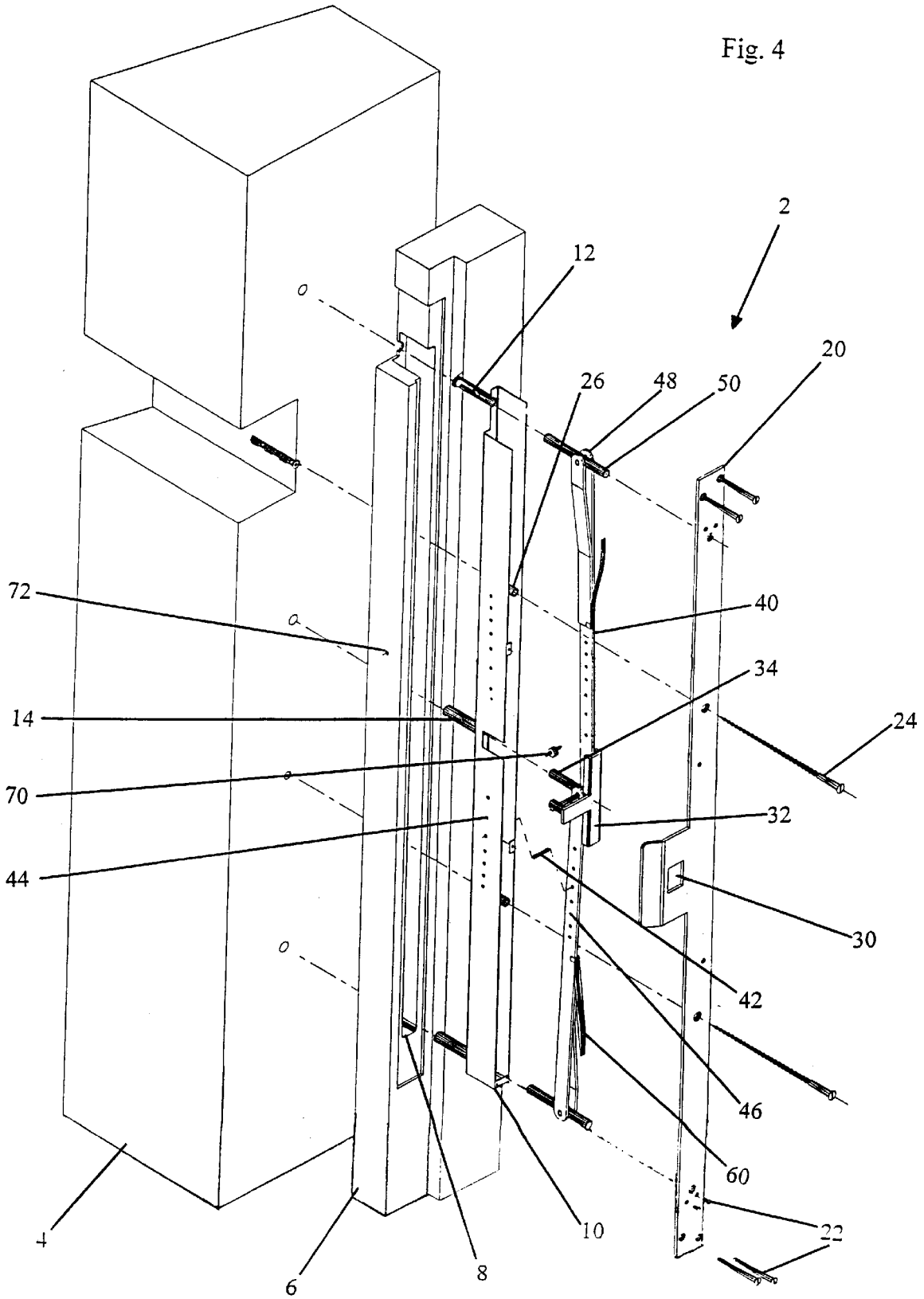
FIG. 4 is an exploded perspective view of a second embodiment of a security locking mechanism according to the invention.

FIG. 4 shows a further embodiment of the security locking mechanism. It differs from the embodiment previously described in that it is used in conjunction with a door provided with a surface mounted night latch. In this instance, the keeper 30 on the metal face plate 20 is located outside the width of the frame 6 and the keeper plate 32 bridges the width of the frame 6 and the keeper 30 so that extension of the bolt of the lock into the keeper 30 is communicated by the keeper plate 32 to the actuating levers 40 and auxiliary bolts 50 housed within the metal monocoque housing 10. This embodiment functions in a similar manner to that previously described.

While the invention has been described with reference to details of the illustrated embodiment, these details are not intended to limit the scope of the invention as defined in the appended claims.

The embodiment of the invention in which an exclusive property or privilege is claimed is defined as follows:

1. A security locking mechanism for enhancing the security provided by a lock carried by a wing, the security locking mechanism comprising:

an auxiliary bolt mechanism for mounting in a frame for the wing and an auxiliary keeper for mounting in the wing, wherein extension of a bolt of the lock into a keeper of said auxiliary bolt mechanism causes extension of an auxiliary bolt of said auxiliary bolt mechanism into said auxiliary keeper against a resilient bias, said auxiliary bolt mechanism comprising a metal housing which in use is received in a recess of said frame, and an actuating lever which is pivotally mounted intermediate its ends in said housing, is pivotally connected at one end portion to a keeper plate positioned to be depressed by extension of said bolt into said keeper, and is pivotally connected at an opposite end portion to the auxiliary bolt, wherein said auxiliary bolt is slidable in a tubular metal anchorage which projects rearwardly from said metal housing and in use is received in and anchored by a structural support for said frame; and when extended said resilient bias, said auxiliary bolt has one end portion received in said tubular metal anchorage and an opposing end portion received in said auxiliary keeper of the wing.

2. A security locking mechanism according to claim 1, wherein said keeper plate is fast to a shaft which is axially slidable in a tubular metal guide which projects rearwardly from said metal housing and in use is received in and anchored by said structural support for the frame.

3. A security locking mechanism according to claim 1, for use with a surface-mounted lock, wherein said keeper in use is located outside the width of said frame alongside the surface-mounted lock, and said keeper plate bridges the width of said frame and said keeper so that extension of a bolt of the lock into said keeper outside the width of said frame is communicated by said keeper plate to said actuating lever and auxiliary bolt within the width of said frame.

4. A security locking mechanism according to claim 3, in which the surface-mounted lock is one which has as its sole bolt a latch bolt.

5. A security locking mechanism according to claim 1, for use with a lock which has both a latch bolt and a deadbolt, wherein said keeper plate is positioned in said metal housing so as to be depressed by extension of one of the group consisting of the latch bolt and the deadbolt into said keeper.

6. A security locking mechanism according to claim 1, wherein said auxiliary bolt mechanism comprises a second actuating lever on an opposing side of said keeper plate to that which is connected to said actuating lever, said second actuating lever being pivotally mounted intermediate its ends in said housing, being pivotally connected at one end portion to said keeper plate and being pivotally connected at an opposite end portion to a second auxiliary bolt which is slidable in a second tubular metal anchorage which projects rearwardly from said metal housing and in use is received in and anchored by the structural support for said frame.

7. A security locking mechanism according to claim 1, further comprising a metal face plate securable to a front of said metal housing.

8. A security locking mechanism according to claim 7, further comprising a pair of tubular metal structural members secured to a back wall of said metal housing and extending from said back wall to said metal face plate, and in alignment with said tubular metal structural members fixing holes formed through said face plate and said back wall of said metal housing, for fixing said face plate and housing directly to the structural support for said frame by means of securing screws passing through said fixing holes, said tubular metal structural members and said frame and obtaining an anchorage in the structural support.

9. A security locking mechanism according to claim 1, further comprising a release mechanism connected to said actuating lever which is accessible through a hole provided in a side wall of said housing and through said frame at one side of said frame only, for mounting said actuating lever so as to disengage said auxiliary bolt mechanism in the event that said mechanism sticks to a locking position.

10. A security locking mechanism for enhancing the security provided by a lock carried by a wing, the security locking mechanism comprising:

an auxiliary bolt mechanism for mounting in a frame for the wing and adapted to interact with an auxiliary keeper mounted in the wing, wherein extension of a bolt of said lock into a keeper of said auxiliary bolt mechanism causes extension of an auxiliary bolt of said auxiliary bolt mechanism into the auxiliary keeper against a resilient bias, said auxiliary bolt mechanism comprising a metal housing which in use is received in a recess in said frame, and an actuating lever which is pivotally mounted intermediate its ends in said housing, is pivotally connected at one end portion to a keeper plate positioned to be depressed by extension of said bolt into said keeper, and is pivotally connected at an opposite end portion to the auxiliary bolt, wherein said auxiliary bolt is slidable in a tubular metal anchorage which projects rearwardly from said metal housing and in use is received in and anchored by a structural support for said frame; and when extended against said resilient bias, said auxiliary bolt has one end portion received in said tubular metal anchorage and an opposing end portion adapted to be slidably received by the auxiliary keeper of the wing.

11. A security locking mechanism according to claim 10, wherein said keeper plate is fast to a shaft which is axially slidable in a tubular metal guide which projects rearwardly from said metal housing and in use is received in and anchored by said structural support for the frame.

12. A security locking mechanism according to claim 10, for use with a surface-mounted lock, wherein said keeper in use is located outside the width of said frame alongside said surface-mounted lock, and said keeper plate bridges the width of said frame and said keeper so that extension of a bolt of the lock into said keeper outside the width of said frame is communicated by said keeper plate to said actuating lever and auxiliary bolt within the width of said frame.

13. A security locking mechanism according to claim 12, in which said surface-mounted lock is one which has as its sole bolt a latch bolt.

14. A security locking mechanism according to claim 10, for use with a lock which has both a latch bolt and a deadbolt, wherein said keeper plate is positioned in said metal housing so as to be depressed by extension of one of the group consisting of said latch bolt and said deadbolt into said keeper.

15. A security locking mechanism according to claim 10, wherein said auxiliary bolt mechanism comprises a second actuating lever on an opposing side of said keeper plate to that which is connected to said actuating lever, said second actuating lever being pivotally mounted intermediate its ends in said housing, being pivotally connected at one end portion to said keeper plate and being pivotally connected at an opposite end portion to a second auxiliary bolt which is slidable in a second tubular metal anchorage which projects rearwardly from said metal housing and in use is received in an anchored by said structural support for said frame.

16. A security locking mechanism according to claim 10, further comprising a metal face plate securable to a front of said metal housing.

17. A security locking mechanism according to claim 16, further comprising a pair of tubular metal structural members secured to a back wall of said metal housing and extending from said back wall to said metal face plate, and in alignment with said tubular metal structural members fixing holes formed through said face plate and said back wall of said metal housing, for fixing said face plate and housing directly to said structural support for said frame by means of securing screws passing through said fixing holes, said tubular metal structural members and said frame and obtaining an anchorage in said structural support.

18. A security locking mechanism according to claim 10, further comprising a release mechanism connected to said actuating lever which is accessible through a hole provided in a side wall of side housing and through said frame at one side of said frame only, for moving said actuating lever so as to disengage said auxiliary bolt mechanism in the event that said mechanism sticks in a locking condition.

* * * * *